US011003111B2

(12) United States Patent
Kadis et al.

(10) Patent No.: US 11,003,111 B2
(45) Date of Patent: May 11, 2021

(54) PRINTING LIQUIDS CONCENTRATION

(71) Applicant: HP INDIGO B.V., Amstelveen (NL)

(72) Inventors: Giries Kadis, Ness Ziona (IL); Marc Klein, Ness Ziona (IL); Mark Sandler, Ness Ziona (IL); Peter Nedelin, Ness Ziona (IL); Marko Richter, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/700,083

(22) Filed: Dec. 2, 2019

(65) Prior Publication Data

US 2020/0103789 A1 Apr. 2, 2020

Related U.S. Application Data

(63) Continuation of application No. 15/772,361, filed as application No. PCT/EP2016/052634 on Feb. 8, 2016, now Pat. No. 10,503,101.

(51) Int. Cl.
*G03G 15/11* (2006.01)

(52) U.S. Cl.
CPC ..... *G03G 15/11* (2013.01); *G03G 2215/0805* (2013.01)

(58) Field of Classification Search
CPC .... G03G 15/10; G03G 15/104; G03G 15/105; G03G 15/11; B01D 11/0211
See application file for complete search history.

(56) References Cited

U.S. PATENT DOCUMENTS

| | | | |
|---|---|---|---|
| 4,204,766 | A | 5/1980 | Harada |
| 4,761,357 | A | 8/1988 | Tavernier et al. |
| 4,974,027 | A | 11/1990 | Landa et al. |
| 5,383,008 | A | 1/1995 | Sheridon |
| 5,610,694 | A | 3/1997 | Lior et al. |
| 5,713,068 | A | 1/1998 | Teschendorf et al. |
| 5,915,153 | A | 6/1999 | Kim et al. |
| 5,933,689 | A | 8/1999 | Kim |
| 6,219,500 | B1 | 4/2001 | Byun |
| 6,324,368 | B1 | 11/2001 | Seto |
| 6,682,865 | B2 | 1/2004 | Viturro et al. |
| 6,850,724 | B2 | 2/2005 | Pang et al. |
| 6,856,778 | B2 | 2/2005 | Vejtasa et al. |
| 7,400,850 | B2 | 7/2008 | Romem |
| 7,471,907 | B2 | 12/2008 | Berg et al. |

(Continued)

FOREIGN PATENT DOCUMENTS

| | | |
|---|---|---|
| CN | 1209582 | 3/1999 |
| CN | 102812403 | 12/2012 |

(Continued)

*Primary Examiner* — Arlene Heredia
(74) *Attorney, Agent, or Firm* — HP Inc. Patent Department

(57) ABSTRACT

An example apparatus includes a conveyor. The apparatus also includes a first developer unit. The first developer unit is to concentrate first printing liquid. The first developer unit also is to deliver the first printing liquid to the conveyor. The apparatus also includes a second developer unit. The second developer unit is to concentrate second printing liquid. The second developer also is to deliver the second printing liquid to the conveyor to form a thick layer of printing liquid comprising the first and second printing liquid.

17 Claims, 6 Drawing Sheets

(56) References Cited

U.S. PATENT DOCUMENTS

| | | | | |
|---|---|---|---|---|
| 7,544,458 | B2 | 6/2009 | Iraqi et al. | |
| 8,055,160 | B2 | 11/2011 | Bhattacharyya et al. | |
| 8,103,194 | B2 | 1/2012 | Patton et al. | |
| 8,496,324 | B2 | 7/2013 | Anthony et al. | |
| 9,327,295 | B2 | 5/2016 | Lior | |
| 9,375,653 | B2 | 6/2016 | Sandler | |
| 2003/0113138 | A1 | 6/2003 | Tagansky | |
| 2003/0118361 | A1 | 6/2003 | Shimmura | |
| 2003/0133726 | A1 | 7/2003 | Song | |
| 2007/0140738 | A1 | 6/2007 | Aruga | |
| 2009/0035023 | A1 | 2/2009 | Thompson et al. | |
| 2009/0060587 | A1 | 3/2009 | Tanjo | |
| 2009/0220282 | A1 | 9/2009 | Kato | |
| 2013/0011162 | A1 | 1/2013 | Nelson et al. | |
| 2014/0356029 | A1 | 12/2014 | Sandler | |
| 2015/0209800 | A1* | 7/2015 | Lior ..... | G03G 15/105<br>204/547 |
| 2015/0298453 | A1 | 10/2015 | Gilan | |
| 2015/0370197 | A1 | 12/2015 | Hirai | |
| 2018/0239273 | A1 | 8/2018 | Nelson | |

FOREIGN PATENT DOCUMENTS

| | | |
|---|---|---|
| EP | 2159269 | 3/2010 |
| GB | 1456210 | 11/1976 |
| WO | WO-9301531 | 1/1993 |
| WO | WO-2011123137 | 10/2011 |
| WO | WO-2013034194 | 3/2013 |
| WO | WO-2013107880 | 7/2013 |
| WO | WO-2014015900 | 1/2014 |
| WO | WO-2016015774 | 2/2016 |

* cited by examiner

300

PRINTING LIQUIDS CONCENTRATION

BACKGROUND

Electro-photography (EP) printing devices may form images on a print target by selectively charging or discharging a photoconductive member, such as a photoconductive drum, based on an image to be printed. The selective charging or discharging may form a latent electrostatic image on the photoconductor. Colorants, or other printing liquids, may be developed onto the latent image of the photoconductor, and the colorant or printing liquid may be transferred to the media to form the image on the media. In dry EP (DEP) printing devices, powdered toner may be used as the colorant, and the toner may be received by the media as the media passes below the photoconductor. The toner may be fixed in place as it passes through heated pressure rollers. In some liquid EP (LEP) printing devices, printing liquid may be used as the colorant instead of toner. In some LEP devices, printing liquid may be developed in a developer unit and then selectively transferred to the photoconductor (a "zero transfer"). For example, the printing liquid may have a charge that causes it to be electrostatically attracted to the latent image on the photoconductor. The photoconductor may transfer the printing liquid to an intermediate transfer member (ITM), which may include a transfer blanket, (a "first transfer"), where it may be heated until a liquid carrier evaporates, or substantially evaporates, and resinous colorants melt. The ITM may transfer the resinous colorants to the surface of the print media (a "second transfer"), which may be supported on a rotating impression member (e.g., a rotating impression drum).

DETAILED DESCRIPTION

Figure 1:
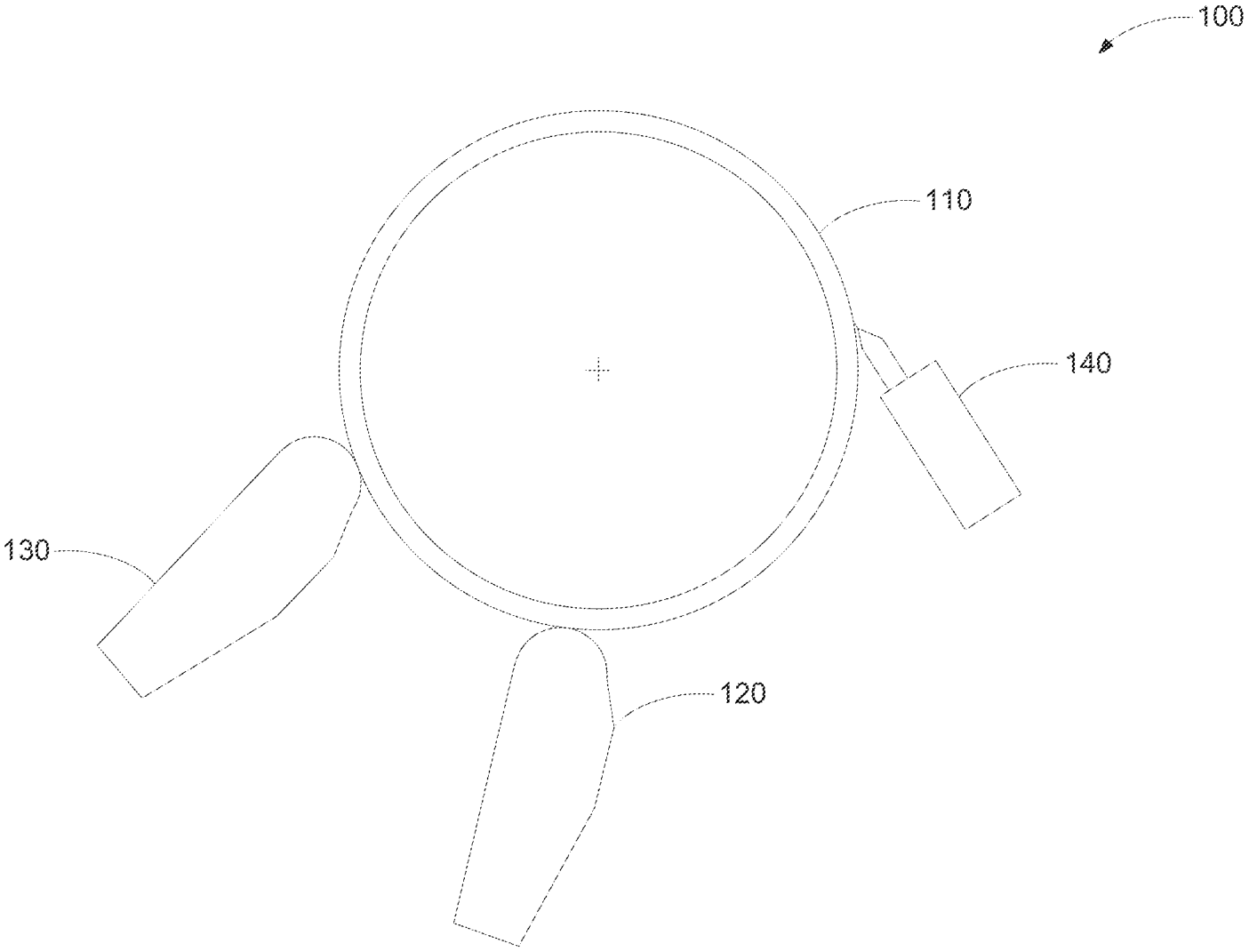
FIG. 1 is a schematic diagram of an example system to concentrate printing liquid.

The printing liquid may include the liquid carrier and non-volatile solids. The liquid carrier may be removed during printing, and the liquid carrier may become waste that needs to be processed by the user. The non-volatile solids may include the colorants that are melted and transferred to the surface of the print media. During manufacturing, the non-volatile solids may be thoroughly mixed in the liquid carrier to ensure an even distribution. In an example, the printing liquid may be mixed to a dilute non-volatile solid concentration of about 3% to 5%. As used herein, the term "non-volatile solid concentration" refers to the mass of the non-volatile solids in a quantity of printing liquid divided by the mass of the quantity of printing liquid including the non-volatile solids.

After the printing liquid has been mixed to the dilute non-volatile solid concentration, the printing liquid may be concentrated to a higher non-volatile solid concentration.

Concentrating the printing liquid may decrease the weight that needs to be shipped for the same quantity of non-volatile solids (i.e., decreases the amount of printing liquid needed to print a particular number of pages). Because less weight is shipped, the shipping cost and environmental impact may be lower. In addition, less liquid carrier waste may be produced during printing. As a result, the end user may have less waste to process.

In an example, the printing liquid may be concentrated in a centrifuge. However, the centrifuge may be noisy and produce a significant amount of vibration. The centrifuge also may operate on small batches of printing liquid and take a long time to concentrate the printing liquid. In addition, the centrifuge may be difficult to clean after the printing liquid has been concentrated. Accordingly, the centrifuge may be inefficient for concentrating printing liquid.

Alternatively, the printing liquid may be concentrated on a conveyor electrophoretically using an electrode. The electrode and the conveyor may be maintained at a potential difference, and the printing liquid may be passed over the electrode. The potential difference may attract the non-volatile solids to the conveyor or repel the non-volatile solids from the electrode. Printing liquid with an increased concentration of non-volatile solids may be deposited on the conveyor. Waste printing liquid with little or no non-volatile solids may flow over the electrode, and the waste printing liquid may be deposited in a waste tank. The printing liquid with the increased concentration of non-volatile solids may be removed from the conveyor and placed in a storage vessel, such as a vessel to be shipped to an end user.

When concentrating the printing liquid with the electrode, the flow of printing liquid to the conveyor may be unstable and non-uniform. In addition, the printing liquid concentration along the width of the conveyor may be non-uniform. The non-volatile solid concentration that can be achieved with the electrode may be lower than desired. The electrode may be difficult to service. The electrode may be inaccessible, may be difficult to clean, and may need to be specially made. The electrode may also be difficult to calibrate and may need precise adjustment of the gap between the electrode and the conveyor. Concentration of printing liquids could be improved by remedying these issues.

In an example, a developer unit may concentrate printing liquid and transfer the printing liquid to the conveyor. The developer unit may provide the printing liquid at a high non-volatile solid concentration and at a high throughput. However, it would be beneficial to achieve higher concentrations and higher throughputs. In addition, the developer unit may allow for limited control on the concentration or throughput of the printing liquid concentration process. Accordingly, concentration of printing liquids could be improved by providing higher concentrations or throughputs as well as more precise control over the concentration or throughput achieved.

FIG. 1 is a schematic diagram of an example system 100 to concentrate printing liquid. The system 100 may include a conveyor 110. In the illustrated example, the conveyor 110 may include a drum. The conveyor 110 may receive printing liquid at its surface and may retain the printing liquid on its surface, for example, electrostatically. The surface of the conveyor 110 may move to transport the printing liquid (e.g., continuously, periodically, aperiodically, or the like). For example, the conveyor 110 may rotate to transport the printing liquid about its circumference.

The system 100 may include a first developer unit 120 and a second developer unit 130. As used herein, the term "developer unit" refers to a device to internally concentrate printing liquid electrophoretically and to deliver the concentrated printing liquid to a conveyor in contact with the developer unit, such as a photoconductor. In the illustrated example, the first and second developer units 120, 130 may concentrate printing liquid and conduct the printing liquid to the conveyor 110 rather than delivering the concentrated printing liquid to a photoconductor. However, in some examples, the first and second developer units 120, 130 may be structurally identical to developer units that deliver printing liquid to photoconductors. In an example, components of the first and second developer units 120, 130 may be set to larger magnitude electrical potentials when used with the conveyor 110 rather than a photoconductor. The first and second developer units 120, 130 may concentrate the printing liquid as it transfers the printing liquid to the conveyor 110 in addition to internally concentrating the printing liquid prior to delivering it to the conveyor 110. The first and second developer units 120, 130 may include channels or conveyors to conduct the printing liquid to the conveyor 110.

In an example, the first developer unit 120 may concentrate first printing liquid, and the second developer unit 130 may concentrate second printing liquid. The first and second printing liquid may come from a same source or distinct sources. The conveyor 110 may rotate clockwise in the illustrated example, and the first developer unit 120 may deliver the first printing liquid as a first layer on the surface of the conveyor 110. The conveyor 110 may rotate the first layer of printing liquid to the second developer unit 130. The second developer unit 130 may deliver the second printing liquid as a second layer on the surface of the conveyor 110. The first and second layers may mix and become indistinguishable after delivery of the second layer to the conveyor 110.

The system 100 may include a wiper 140. The wiper 140 may remove the first and second layers of printing liquid from the conveyor 110. In the illustrated example, the first and second developer units 120, 130 may deliver the first and second layers of concentrated printing liquid to the conveyor 110. The conveyor 110 may rotate clockwise to transport the first and second layers of concentrated printing liquid away from the first and second developer units 120, 130 and to the wiper 140. The wiper 140 may remove the first and second layers of concentrated printing liquid when they arrive at the wiper 140. In an example, the wiper 140 may scrape the concentrated printing liquid from the surface of the conveyor 110 to remove the concentrated printing liquid.

Figure 2:
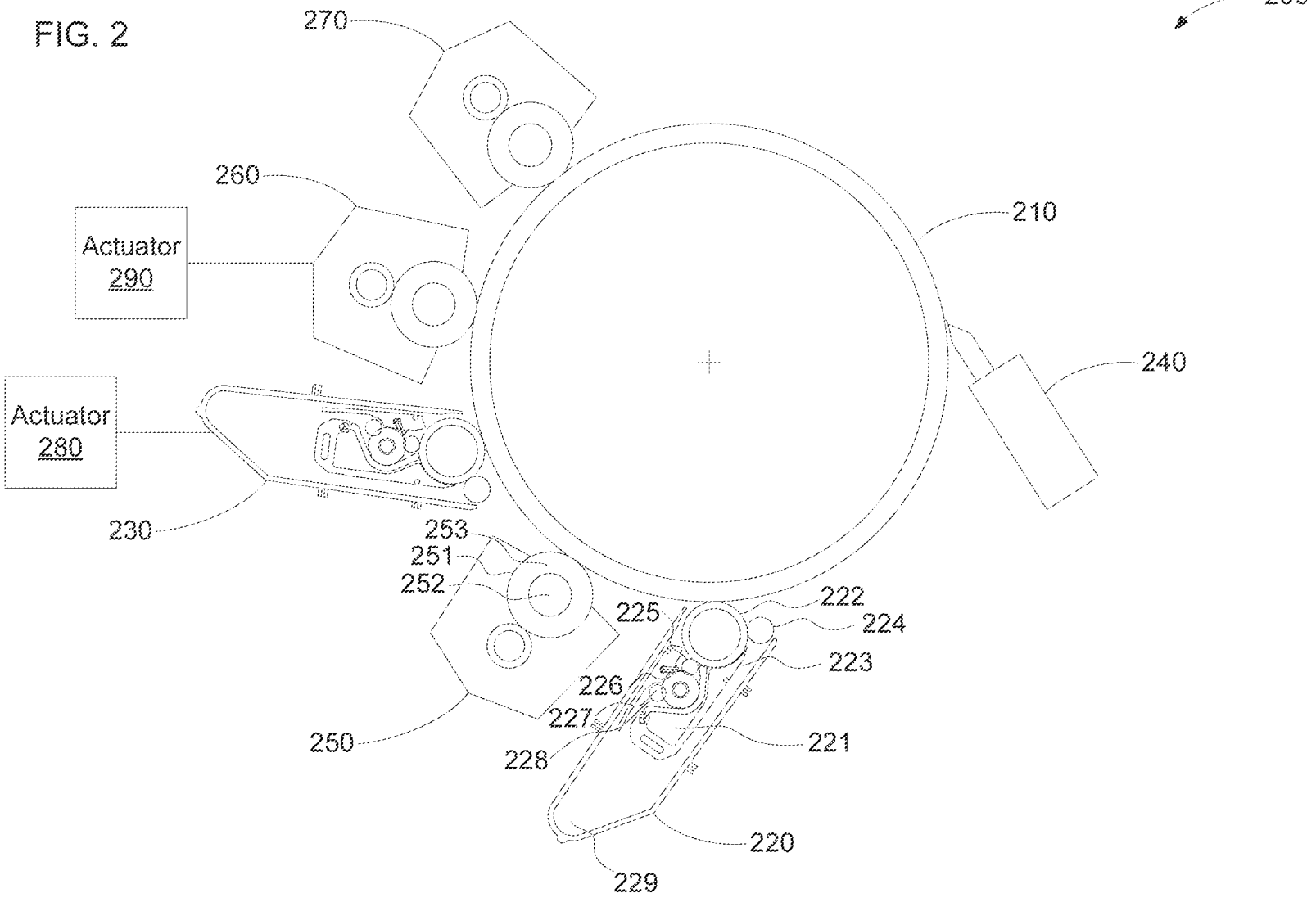
FIG. 2 is a schematic diagram of another example system to concentrate printing liquid.

FIG. 2 is a schematic diagram of another example system 200 to concentrate printing liquid. The system 200 may include a conveyor 210 to transport concentrated printing liquid on its surface. The conveyor 210 may have a continuous surface that forms a loop. In some examples, the conveyor 210 may include a rotatable drum. The surface of the conveyor 210 may support and transport the concentrated printing liquid. The conveyor 210 may have a potential applied to it, and non-volatile solids in the printing liquid may adhere to the conveyor 210 when the potential is applied. The conveyor 210 may include a metal, such as steel, aluminum, copper, an alloy of these metals, or the like. In an example, the conveyor 210 may include a metal substrate covered by a non-metallic material, such as a polymer, an elastomer, a ceramic, or the like.

The system 200 may include a first developer unit 220 to concentrate first printing liquid and deliver the first printing liquid to the conveyor 210 as a first layer of printing liquid. The first developer unit 220 may include a printing liquid inlet 221 at which it receives the first printing liquid, which may have a low non-volatile solid concentration. The inlet 221 may deliver the printing liquid to a cavity of an electrode 223. The cavity of the electrode 223 may direct the flow of the printing liquid to a developer roller 222. A potential may be applied to the developer roller 222. For example, the developer roller 222 may be biased to a potential of at most about −500 V, −1000 V, −1500 V, −2000 V, −2500 V, −3000 V, or the like. As used herein, the term "at most" refers to a value that is less than or equal to another value, and the term "at least" refers to a value that is greater than or equal to another value. For example, the value −3000 is less than the value −2500. There may be some error in the applied potential (e.g., an error of 0.1%, 0.5%, 1%, 2%, 5%, etc.). Thus, as used herein, the term "about" a particular voltage refers to a potential that is within an error margin of the particular voltage.

The electrode 223 may concentrate the printing liquid on the developer roller 222. In an example, the electrode 223 may be biased to a potential of at most about −1200 V, −1500 V, −2000 V, −2500 V, −3000 V, −3500 V, −4000 V, or the like. The magnitude of the potential of the electrode 223 may be greater than the magnitude of the potential of the developer roller 222. The non-volatile solids in the printing liquid may be negatively charged, so the non-volatile solids may be repelled away from the electrode 223 and attach to the surface of the developer roller 222. Liquid carrier may attach to the surface of the developer roller 222 as well. Some liquid carrier with little or no non-volatile solids may flow over the electrode 223 and travel to an outlet 229. Accordingly, the electrode 223 may remove liquid carrier from the printing liquid thereby concentrating the printing liquid on the surface of the developer roller 222.

The developer roller 222 may rotate and transport the printing liquid on its surface to a squeegee roller 224. The squeegee roller 224 may be biased to a potential of at most about −800 V, −1000 V, −1500 V, −2000 V, −2500 V, −3000 V, −3500 V, or the like. The magnitude of the potential of the squeegee roller 224 may be greater than the magnitude of the potential of the developer roller 222. The non-volatile solids may remain on the surface of the developer roller 222 due to the potential difference, but the squeegee roller 224 may apply a mechanical force that removes some of the liquid carrier, which may travel to the outlet 229. For example, the squeegee roller 224 may be in contact with the developer roller 222, and the squeegee roller 224 may rotate to pull the liquid carrier from the developer roller 222. The removal of the liquid carrier by the squeegee roller 224 may further concentrate the printing liquid on the surface of the developer roller 222.

The developer roller 222 may transport the printing liquid concentrated by the electrode 223 and the squeegee roller 224 to the conveyor 210. In an example, the conveyor 210 may be biased to a potential of at least or at most about 1500 V, 1000 V, 500 V, 0 V, −500 V, or the like. The potential difference between the developer roller 222 and the conveyor 210 may cause the printing liquid, including the non-volatile solids, to transfer from the developer roller 222 to the conveyor 210. The transferred printing liquid may form a first layer of printing liquid on the conveyor 210. In some examples, some liquid carrier with little or no non-volatile solids may remain on the developer roller 222, and the printing liquid may be further concentrated during the transfer to the conveyor 210. The concentrated printing liquid on the conveyor 210 may be a non-Newtonian fluid and may have a paste consistency.

The developer roller 222 may be cleaned to remove any printing liquid that did not transfer to the conveyor 210. The developer unit 210 may include a cleaner roller 225 to remove the printing liquid remaining on the developer roller 222. The cleaner roller 225 may be at a positive or negative potential relative to the developer unit 210 depending on whether the cleaner roller 225 is to remove non-volatile solids or just liquid carrier. In an example, the cleaner roller 225 may be biased to a potential of at most or at least about −250 V, −500 V, −1000 V, −1500 V, −2000 V, −2500 V, −3000 V, −3500 V, or the like. A wiper 226 may remove printing liquid from the cleaner roller 225. A sponge roller 227 may move the printing liquid away from the vicinity of the cleaner roller 225 and the wiper 226. A squeezer roller 228 may remove the printing liquid from the sponge roller 227 so that it can drain to the outlet 229.

The system 200 also may include a second developer unit 230 to concentrate second printing liquid and deliver the second printing liquid to the conveyor 210 as a second layer of printing liquid. The second developer unit 230 may include a similar structure to the first developer unit 220 to concentrate the second printing fluid internally, or the second developer unit 230 may include a distinct structure. The conveyor 210 may rotate the first layer of printing liquid from the first developer unit 220 to the second developer unit 230. The second developer unit 230 may deliver the second layer of printing liquid on top of the first layer of printing liquid. For example, the conveyor 210 or the second developer unit 230 may apply mechanical or electrical forces to the second printing liquid. The mechanical or electrical forces may transfer the second printing liquid to the surface of the conveyor 210 despite the presence of the first printing liquid.

The system 200 may include a plurality of squeegee units 250, 260, 270 to further concentrate the printing liquid on the conveyor 210. For example, the system 200 may include a first squeegee unit 250 between the first developer unit 220 and the second developer unit 230. After the first developer unit 220 has concentrated the first printing liquid and delivered the first layer of printing liquid to the conveyor 210, the conveyor 210 may transport the first layer of printing liquid to the first squeegee unit 250. The first squeegee unit 250 may apply mechanical or electrical force to the first layer of printing liquid on the conveyor 210 to concentrate the first layer of printing liquid. In an example, the first squeegee unit 250 may not act on the second layer of printing liquid, which may be added to the conveyor 210 at a location after that of the first squeegee unit 250. The first squeegee unit 250 may include a roller 251. In an example, the roller 251 may include a metallic core 252 and a non-metallic coating 253. The roller 251 may be biased to a potential of at most about −500 V, −1000 V, −1500 V, −2000 V, −2500 V, −3000 V, −3500 V, −4000 V, or the like. The roller 251 may apply the electrical and mechanical forces to the first layer of printing liquid on the surface of the conveyor 210. The roller 251 may rotate to apply a mechanical force to remove liquid carrier from the first layer of printing liquid. The potential of the roller 251 may apply an electrical force that causes the non-volatile solids to remain on the surface of the conveyor 210. Thus, the concentration of the first layer of printing liquid on the surface of the conveyor 210 may be increased.

After the first squeegee unit 250 has further concentrated the first layer of printing liquid and the second developer unit 230 has added the second layer of printing liquid, the conveyor 210 may transport the first and second layers of printing liquid to a second squeegee unit 260. The second squeegee unit 260 may concentrate the second layer of printing liquid further. In some examples, the second squeegee unit 260 may concentrate the first layer of printing liquid further as well. In an example, the second squeegee unit 250 may operate similarly to the first squeegee unit 250 to concentrate the printing liquid on the conveyor 210 further. The system 200 may also include a third squeegee unit 270. The conveyor 210 may transport the first and second layers of printing liquid from the second squeegee unit 260 to the third squeegee unit 270, which may concentrate the first or second layer of printing liquid further.

The system 200 may also include a first actuator 280 to engage and disengage the second developer unit 230 to and from the conveyor 210. In some examples, the system 200 may also, or instead, include an actuator to engage and disengage the first developer unit 220 to and from the conveyor 210. Each of the first and second developer units 220, 230 may be independently engaged to or disengaged from the conveyor 210. The first actuator 280 may engage the second developer unit 230 to the conveyor 210 when the second developer unit 230 is delivering the second layer of printing liquid to the conveyor 210. The first actuator 280 may also allow the system 200 to be modified to other configurations. For example, the first actuator 280 may disengage the second developer unit 230 from the conveyor 210, and a single layer of printing liquid may be delivered to the conveyor 210 rather than two layers. Accordingly, the first actuator 280 may adjust the throughput of the system 200.

The system 200 may include a second actuator 290 to engage and disengage the second squeegee unit 260 to and from the conveyor 210. In some examples, the system 200 may also, or instead, include actuators to engage and disengage the first or third squeegee units 250, 270 to and from the conveyor 210. Each of the plurality of squeegee units 250, 260, 270 may be independently engaged to or disengaged from the conveyor 210. The second actuator 290 may allow the configuration of the system to be modified. For example, the concentration of the printing liquid produced by the system 200 may be adjusted by engaging or disengaging the second squeegee unit 260. Thus, the first and second actuator 280, 290 may be controlled based on the desired throughput and concentration to be output by the system 200.

The conveyor 210 may transport the first and second layers of printing liquid from the third squeegee unit 270 to a wiper 240. The wiper 240 may remove the first and second layers of printing liquid from the conveyor 210. In an example, the wiper 240 may include a plate or blade of a rigid material, such as a metal or polymer, in contact with the conveyor 210. The wiper 240 may scrape the first and second layers of printing liquid from the conveyor 210. The printing liquid may travel down the wiper 240. For example, gravity may pull the printing liquid down the wiper 240. Alternatively, or in addition, the rotation of the conveyor 210 may continuously push additional printing liquid onto the wiper 240, which in turn may push the printing liquid already on the wiper 240. The wiper 240 may transport the printing liquid to further processing or to a storage vessel (not shown), such as a storage vessel to be shipped to a user. In some examples, the system 200 may include an actuator (not shown) to engage and disengage the wiper 240 from the conveyor 210.

In an example, the first and second developer units 220, 230 may receive the first and second printing liquid at a non-volatile solid concentration of no more than 5% (e.g., less than 1%, 1% to 3%, 3% to 5%, etc.) or the like. In some examples, the first developer unit 220 may concentrate the first layer of printing liquid to a non-volatile solid concentration of at least 13%, 15%, 18%, 20%, 23%, 25%, or the like. The first squeegee unit 250 may further concentrate the first layer of printing liquid to a non-volatile solid concentration of at least 15%, 20%, 25%, 30%, 35%, 40%, 45%, 50%, or the like. The second developer unit 230 may concentrate the second layer of printing liquid to a non-volatile solid concentration of at least 13%, 15%, 18%, 20%, 23%, 25%, or the like. The overall non-volatile solid concentration of the first and second layers of printing liquid after the further concentration by the second and third squeegee units 260, 270 may be at least 25%, 30%, 35%, 40%, 45%, 50%, 55%, 60% or the like. The printing liquid may be provided to the end user at that concentration.

When just one of the developer units 220, 230 is engaged to the conveyor 210, the system 200 may output concentrated printing liquid at a normalized rate of at least five, six, seven, eight, nine, ten, or the like kilograms per hour. As used herein, the term "normalized rate" refers to a rate corrected for the concentration of the printing liquid. For example, the rate may be normalized to that of a liquid with a 100% non-volatile solid concentration. A single developer unit 220, 230 may produce a layer on the conveyor 210 with a thickness of at least 1 micrometer (μm), 2 μm, 3 μm, 4 μm, 5 μm, or the like. The thickness may be before or after further concentration by the plurality of squeegee units 250, 260, 270. When both developer units 220, 230 are engaged to the conveyor 210, the system 200 may output concentrated printing liquid at a normalized rate of at least 15, 18, 20, 23, 25, 28, or the like kilograms per hour. Both developer units 220, 230 may produce a layer on the conveyor 210 with a thickness of at least 2 μm, 3 μm, 4 μm, 5 μm, 6 μm, 7 μm, 8 μm, or the like. The thickness may be before or after further concentration by the plurality of squeegee units 250, 260, 270.

The system 200 may produce printing liquid with a high non-volatile solid concentration at a high rate. The first and second developer units 220, 230 may provide a stable and uniform flow of printing liquid to the conveyor 210, and the first and second developer units 220, 230 may deliver a uniform concentration of printing liquid along the entire width of the conveyor 210. The first and second developer units 220, 230 may be accessed easily and may be a mass produced printer part that can be replaced inexpensively and quickly when servicing the system 200. In addition, there may be no need to align or clean a gap between the first and second developer units 220, 230 and the conveyor 210. Thus, the system 200 may provide excellent performance concentrating printing liquid with low maintenance costs.

In addition, the use of a plurality of developer units 220, 230 may provide a throughput that is more than double that achieved with a single developer unit. The system 200 may also achieve higher concentrations with two developer units 220, 230 and thee squeegee units 250, 260, 270 than can be achieved with a single developer unit and two squeegee units. Moreover, the actuators 280, 290 may allow the concentration or throughput to be adjusted based on the operator's needs. Although the illustrated example includes two developer units 220, 230 and three squeegee units 250, 260, 270, other examples may include more or fewer developer units, more or fewer squeegee units, or a different arrangement of developer units and squeegee units around the circumference of the conveyor.

Figure 3:
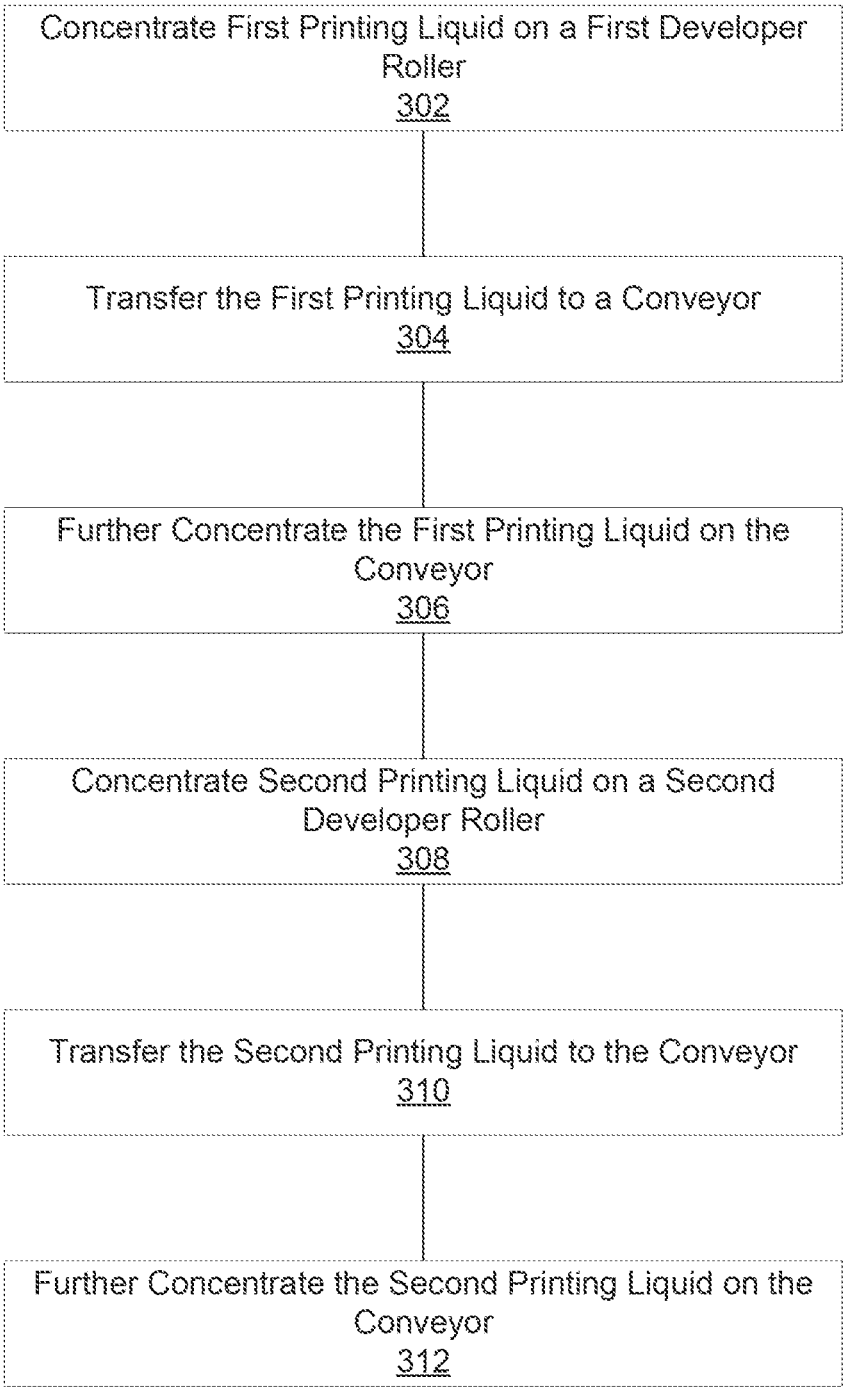
FIG. 3 is a flow diagram of an example method to concentrate printing liquid.

FIG. 3 is a flow diagram of an example method 300 to concentrate printing liquid. At block 302, the method 300 may include concentrating first printing liquid on a first developer roller. For example, liquid carrier may be removed from the first printing liquid on the first developer roller to yield a higher concentration of non-volatile solids in the remaining printing liquid. Mechanical or electrical force may be applied to the first printing liquid to concentrate the first printing liquid. For example, an electrical force may be applied to the non-volatile solids to drive the non-volatile solids toward the first developer roller, and a mechanical force may be applied to remove liquid carrier from the first printing liquid.

Block 304 may include transferring the first printing liquid to a conveyor. In an example, the first developer roller may be in contact with the conveyor. Electrical or mechanical force may be applied to the first printing liquid to transfer the first printing liquid from the first developer roller to the conveyor. The conveyor may be at a higher potential than the first developer roller to drive negatively charged non-volatile solids in the first printing liquid toward the conveyor. The surface of the conveyor may move relative to the first developer roller to pull the first printing liquid off the developer roller. The non-volatile solid concentration may or may not increase during transfer to the conveyor.

Block 306 may include further concentrating the first printing liquid on the conveyor. Liquid carrier may be removed from the first printing liquid on the surface of the conveyor to increase the concentration of non-volatile solids. For example, mechanical or electrical force may be applied to the first printing liquid to pull the liquid carrier off the conveyor without removing the non-volatile solids from the conveyor. Accordingly, there may be a higher concentration of non-volatile solids in the liquid carrier remaining on the conveyor.

At block 308, the method 300 may include concentrating second printing liquid on a second developer roller. The second printing liquid may come from the same source as the first printing liquid or a separate source. The second printing liquid may be concentrated by removing liquid carrier from the second printing liquid while it is on the second developer roller. For example, mechanical or electrical force may be applied to the second printing liquid to remove the liquid carrier and concentrate the second printing liquid. An electrical force may be applied to the non-volatile solids to drive the non-volatile solids toward the second developer roller, and a mechanical force may be applied to pull liquid carrier from the printing liquid.

Block 310 may include transferring the second printing liquid to the conveyor. The second printing liquid may be transferred on top of the first printing liquid, which may already be on the conveyor. For example, the second developer roller may be in contact with the conveyor, and electrical or mechanical force may be applied to the second printing liquid to transfer the second printing liquid from the second developer roller to the conveyor. The conveyor may be at a higher potential than the second developer roller. The potential difference may drive negatively charged non-volatile solids in the second printing liquid towards the conveyor despite the presence of the first printing liquid on the conveyor. In addition, the surface of the conveyor may move relative to the second developer roller and may pull the second printing liquid off the second developer roller. The electrical or mechanical force may pull the second printing liquid on top of the first printing liquid. The non-volatile solid concentration of the second printing liquid may or may not increase during transfer.

Block 312 may include further concentrating the second printing liquid on the conveyor. The second printing liquid may be concentrated by removing liquid carrier. Mechanical or electrical force may be applied to the second printing liquid to remove the liquid carrier from the second printing liquid without removing non-volatile solids thereby concentrating the second printing liquid. In some examples, the mechanical or electrical force may also, or instead, concentrate the first printing liquid on the conveyor. In an example, the first developer unit 220 of FIG. 2 may perform blocks 302 and 304; the first squeegee unit 250 may perform block 306; the second developer unit 230 may perform blocks 308 and 310; and the second squeegee unit 260 may perform block 312.

Figure 4:
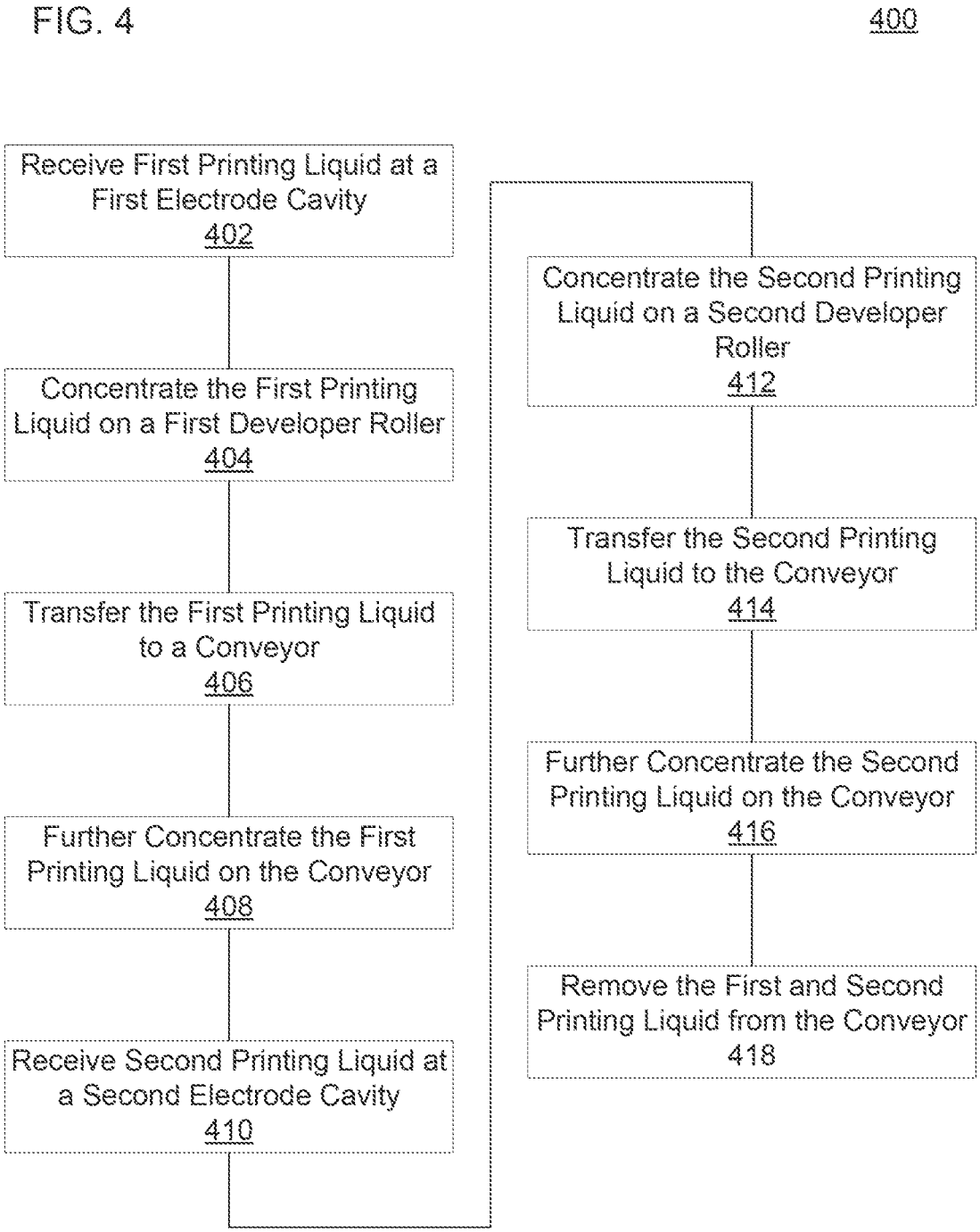
FIG. 4 is a flow diagram of another example method to concentrate printing liquid.

FIG. 4 is a flow diagram of another example method 400 to concentrate printing liquid. At block 402, the method 400 may include receiving first printing liquid at a first electrode cavity. For example, a first developer unit may include the first electrode cavity and an adjacent inlet. The first printing liquid may flow into the first electrode cavity from the inlet. The first printing liquid may flow through the first electrode cavity to a first developer roller. The first printing liquid may arrive at the surface of the first developer roller, and the first developer roller may transport the first printing liquid away from the first electrode cavity. In an example, the first printing liquid received at the first electrode cavity may include a non-volatile solid concentration of no more than 5% (e.g., less than 1%, 1% to 3%, 3% to 5%, etc.).

Block 404 may include concentrating the first printing liquid on the first developer roller. A first electrode (e.g., a first electrode defining the first electrode cavity) may provide an electrical force that repels non-volatile solids from the first electrode and toward the first developer roller. For example, the non-volatile solids may have a negative charge, and the first electrode may be set to a lower electrical potential than the first developer roller. Liquid carrier may flow over the first electrode and away from the first developer roller while the non-volatile solids remain on the first developer roller. Alternatively, or in addition, the first developer roller may transport the first printing liquid to a first squeegee roller. The first squeegee roller may apply mechanical or electrical force to the first printing liquid on the first developer roller. For example, the first squeegee roller may be set to a lower electrical potential than the first developer roller, but its rotation may carry the first printing liquid away from the first developer roller. As a result, the mechanical and electrical forces may pull liquid carrier away from the first developer roller while pushing non-volatile solids towards the first developer roller. The first electrode or first squeegee roller may increase the concentration of non-volatile solids by removing the liquid carrier from the first developer roller while the non-volatile solids remain on the first developer roller.

At block 406, the method 400 may include transferring the first printing liquid to a conveyor. The first developer roller may be in contact with the conveyor, and the first developer roller and conveyor may rotate. In addition, the conveyor may be at a higher electrical potential than the first developer roller. The rotation and electrical potential may apply mechanical and electrical forces on the first printing liquid that cause the first printing liquid to transfer from the first developer roller to the conveyor. In some examples, the concentration of the first printing liquid may increase when it is transferred to the conveyor. The first printing liquid transferred to the conveyor may have a non-volatile solid concentration of at least 13%, 15%, 18%, 20%, 23%, 25%, or the like.

At block 408, the method 400 may include further concentrating the first printing liquid on the conveyor. For example, a first squeegee unit may apply electrical or mechanical force to the first printing liquid to remove additional liquid carrier from the first printing liquid. The first squeegee unit may include a roller that rotates to pull the liquid carrier away from the conveyor while an electrical potential between the roller and the conveyor pushes non-volatile solids towards the conveyor. The first printing liquid that remains on the conveyor may have a higher non-volatile solid concentration after the additional liquid carrier is removed. In an example, the first printing liquid may be further concentrated to a non-volatile solid concentration of at least 15%, 20%, 25%, 30%, 35%, 40%, 45%, 50%, or the like. The number of squeegee units used to concentrate the first printing liquid may be selected based on the desired non-volatile solid concentration.

Block 410 may include receiving second printing liquid at a second electrode cavity. For example, a second developer unit may include a second electrode cavity and an adjacent inlet at which the second developer unit receives the second printing fluid. In an example, the second printing liquid received at the second electrode cavity may include a non-volatile solid concentration of no more than 5% (e.g., less than 1%, 1% to 3%, 3% to 5%, etc.). The second electrode cavity may direct the second printing fluid to a second developer roller. At block 412, the method 400 may include concentrating the second printing liquid on the second developer roller. The second developer roller may transport the second printing liquid past a second electrode or a second squeegee roller. The second electrode or second squeegee roller may apply electrical or mechanical force to the second printing liquid to remove liquid carrier and concentrate the second printing liquid.

Block 414 may include transferring the second printing liquid to the conveyor. The second developer roller or the conveyor may apply mechanical or electrical force to the second printing liquid to transfer the second printing liquid to the conveyor. The concentration of the second printing liquid may or may not increase when it is transferred to the conveyor. After transfer to the conveyor, the second printing liquid may have a non-volatile solid concentration of at least 13%, 15%, 18%, 20%, 23%, 25%, or the like. Block 416 may include further concentrating the second printing liquid on the conveyor. For example, a second squeegee unit may apply electrical or mechanical force to the second printing liquid to remove additional liquid carrier from the second printing liquid. The second squeegee unit may also, or instead, concentrate the first printing liquid. In an example, the second printing liquid may be further concentrated to a non-volatile solid concentration of at least 25%, 30%, 35%, 40%, 45%, 50%, 55%, 60%, or the like. The number of squeegee units used to concentrate the second printing liquid may be selected based on the desired non-volatile solid concentration.

Block 418 may include removing the first and second printing liquid from the conveyor. In an example, the first and second printing liquid may be removed from the conveyor by scraping the first and second printing liquid from the conveyor. A wiper that includes a rigid blade or plate may be in contact with the conveyor, and the rigid blade or plate may scrape the first and second printing liquid from the conveyor. The wiper may span the width of the conveyor. The first and second printing liquid may travel down the wiper to further processing or to a storage vessel. Referring to FIG. 2, the first developer unit 220, for example, may perform blocks 402, 404, and 406; the first squeegee unit 250, for example, may perform block 408; the second developer unit 230, for example, may perform blocks 410, 412, and 414; the second squeegee unit 260, for example, may perform block 416; and the wiper 240, for example, may perform block 418.

Figure 5:
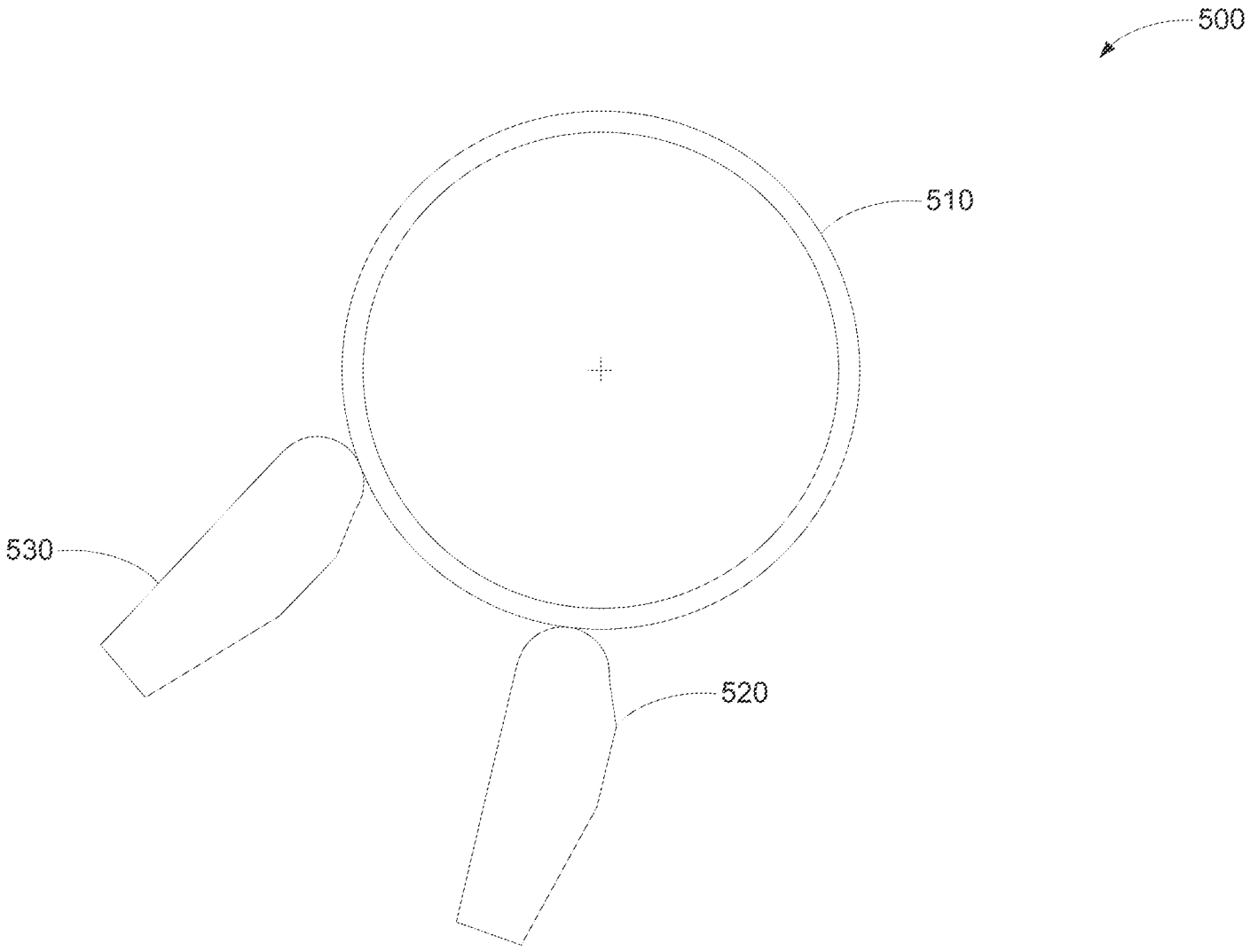
FIG. 5 is a schematic diagram of an example apparatus to concentrate printing liquid.

FIG. 5 is a schematic diagram of an example apparatus 500 to concentrate printing liquid. The apparatus 500 may include a conveyor 510. The conveyor 510 may carry printing liquid on its surface and transport the printing liquid. For example, the surface of the conveyor 510 may move to transport the printing liquid. In an example, the surface may move in a loop. In the illustrated example, the conveyor 510 may include a drum, which may transport the printing liquid by rotating.

The apparatus 500 may also include first and second developer units 520, 530. The first and second developer units 520, 530 may concentrate first and second printing liquid respectively. For example, the first and second developer units 520, 530 may remove liquid carrier from the first and second printing liquids to increase the concentration of non-volatile solids in the first and second printing liquid. The first developer unit 520 may deliver the first printing liquid to the surface of the conveyor 510, and the second developer unit 530 may deliver the second printing liquid to the conveyor 510. The second developer unit 530 may deliver the second printing liquid on top of the first printing liquid. The first and second developer units 520, 530 may form a thick layer on the conveyor 510 from the first and second printing liquids. As used herein, the term forming a "thick layer" refers to a single developer unit delivering a layer with a thickness of at least 1 μm, 2 μm, 3 μm, 4 μm, 5 μm, or the like or multiple developer units delivering a layer with a thickness of at least 2 μm, 3 μm, 4 μm, 5 μm, 6 μm, 7 μm, 8 μm, or the like. A single developer unit may deliver printing liquid to the conveyor at a normalized rate of at least five, six, seven, eight, nine, ten, or the like kilograms per hour, or multiple developer units may deliver printing liquid to the conveyor at a normalized rate of at least 15, 18, 20, 23, 25, 28, or the like kilograms per hour. The thick layer may be too thick for delivery to a photoconductor for printing. However, the thick layer may allow for high throughput production of concentrated printing liquid. The first and second developer units 520, 530 may be operated at high potentials to produce the thick layer of printing liquid.

Figure 6:
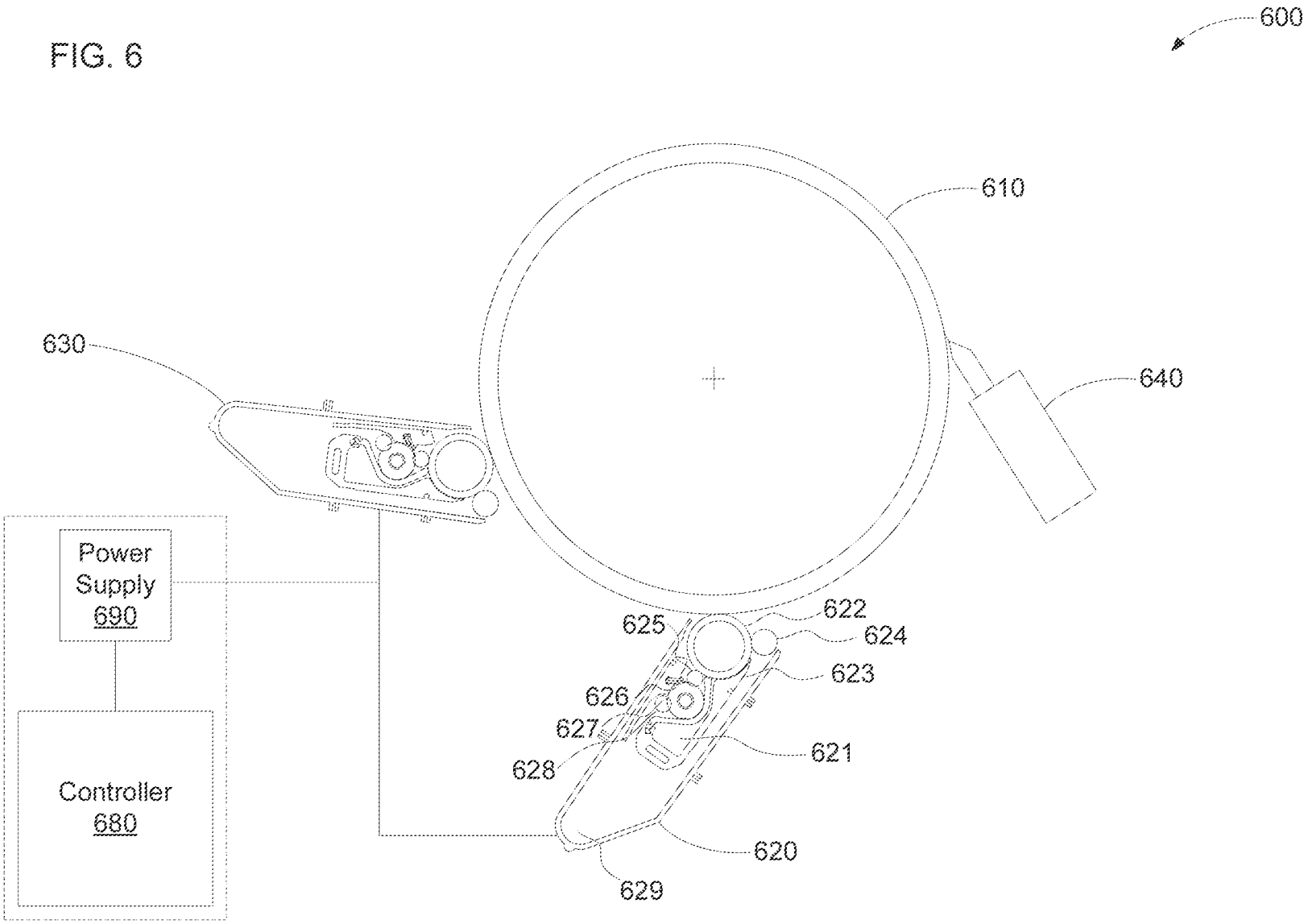
FIG. 6 is a schematic diagram of another example apparatus to concentrate printing liquid.

FIG. 6 is a schematic diagram of another example apparatus 600 to concentrate printing liquid. The apparatus 600 may include a conveyor 610 to transport printing liquid. For example, the conveyor 610 may include a rotating drum to transport the printing liquid. The apparatus 600 may also include first and second developer units 620, 630. In an example, the first developer unit 620 may include a liquid inlet 621 to receive first printing liquid and to conduct the first printing liquid to a developer roller 622. The first developer unit 620 may concentrate the first printing liquid on the developer roller 622. For example, the first developer unit 620 may apply mechanical or electrical forces to the first printing liquid on the developer roller 622 to remove liquid carrier from the first printing liquid thereby increasing the concentration of non-volatile solids in the first printing liquid. An electrode 623 or squeegee roller 624 may apply the mechanical or electrical forces to the first printing liquid to concentrate the first printing liquid.

After concentrating the first printing liquid, the first developer unit 620 may deliver the first printing liquid to the conveyor 610. The developer roller 622 may transport the first printing liquid to the conveyor 610, for example, by rotating the first printing liquid until it reaches the conveyor 610. The developer roller 622 and the conveyor 610 may apply mechanical or electrical force to the first printing liquid to transfer the first printing liquid to the conveyor 610. The first developer unit 620 may also include a cleaner roller 625. The cleaner roller 625 may remove any remaining first printing liquid from the developer roller 622. The cleaner roller 625 may remove liquid carrier from the developer roller 622 without removing non-volatile solids or may remove non-volatile solids from the developer roller 622. The first developer unit 620 may include a wiper 626, a sponge roller 627, and a squeezer roller 628 to remove the first printing liquid from the cleaner roller 625 and to transport the first printing liquid to an outlet 629.

The second developer unit 630 may concentrate second printing liquid and deliver the second printing liquid to the conveyor 610. In some examples, the second developer unit 630 may include similar elements and a similar structure to the first developer unit 620. The second developer unit 630 may deliver the second printing liquid on top of the first printing liquid. The first or second developer unit 620, 630 may form a thick layer on the conveyor 610 from the first or second printing liquids. The first and second developer units 620, 630 may operate at large magnitude potentials to produce the thick layer from the first and second printing liquids.

For example, the apparatus 600 may include a power supply 690 to apply the electrical potentials to the conveyor 610 or elements of the first and second developer unit 620, 630. The apparatus 600 may also include a controller 680 to instruct the power supply 690 at which potential to set each element. In the illustrated example, there is a single integral controller 680 and a single integral power supply 690. In other examples, the functions of the controller 680 and the power supply 690 may be distributed among a plurality of controllers and power supplies. As used herein, the term "controller" refers to hardware (e.g., a processor, such as an integrated circuit, or analog or digital circuitry) or a combination of software (e.g., programming such as machine- or processor-executable instructions, commands, or code such as firmware, a device driver, programming, object code, etc.) and hardware. Hardware includes a hardware element with no software elements such as an application specific integrated circuit (ASIC), a Field Programmable Gate Array (FPGA), etc. A combination of hardware and software includes software hosted at hardware (e.g., a software module that is stored at a processor-readable memory such as random access memory (RAM), a hard-disk or solid-state drive, resistive memory, or optical media such as a digital versatile disc (DVD), and/or executed or interpreted by a processor), or hardware and software hosted at hardware. The term "power supply" refers to hardware to output electrical energy at particular voltages. For example, the power supply 690 may output electrical energy at voltages indicated to the power supply 690. The power supply 690 may modify the voltages dynamically, for example, based on communications from the controller 680. The power supply 690 may include software as well as hardware in some examples.

In some examples, the controller 680 and the power supply 690 may apply a potential of at most about −500 V, −1000 V, −1500 V, −2000 V, −2500 V, −3000 V, or the like to the developer roller 622. The controller 680 and the power supply 690 may apply electrical potentials to the electrode 623 and the squeegee roller 624 that are less or much less than the potential of the developer roller 622 to concentrate the first printing liquid on the developer roller 622. For example, the controller 680 and the power supply 690 may apply a potential of at most about −1200 V, −1500 V, −2000

V, −2500 V, −3000 V, −3500 V, −4000 V, or the like to the electrode 623 and a potential of at most about −800 V, −1000 V, −1500 V, −2000 V, −2500 V, −3000 V, −3500 V, or the like to the squeegee roller 624. The controller 680 and the power supply 690 may apply an electrical potential to the conveyor 610 that is greater or much greater than the electrical potential of the developer roller 622 to transfer the first printing liquid to the conveyor 610. The controller 680 and the power supply 690 may apply a potential of at least or at most about 1500 V, 1000 V, 500 V, 0 V, −500 V, or the like to the conveyor 610. The controller 680 and the power supply 690 may apply large magnitude potentials to allow for concentration of more printing liquid and to provide a higher throughput.

The controller 680 and the power supply 690 also may apply a potential to the cleaner roller 625. The potential of the cleaner roller 625 may be greater than or less than the potential of the developer roller 622. For example, the cleaner roller 625 may be at a potential less than the developer roller 622 so that the cleaner roller 625 removes liquid carrier from the developer roller 622 but does not remove non-volatile solids from the developer roller 622. The controller 680 and the power supply 690 may apply a potential of at most or at least about −250 V, −500 V, −1000 V, −1500 V, −2000 V, −2500 V, −3000 V, −3500 V, or the like to the cleaner roller 625. The controller 680 and the power supply may apply similar potentials to the second developer unit 630. In some examples, the first and second developer units 620, 630 may provide printing liquid to the conveyor 610 at a normalized rate of at least 15, 18, 20, 23, 25, 28, or the like kilograms per hour. The first and second developer units 620, 630 may produce a layer on the conveyor 610 with a thickness of at least 2 μm, 3 μm, 4 μm, 5 μm, 6 μm, 7 μm, 8 μm, or the like. The apparatus 600 may include a wiper 640 to remove the printing liquid for storage or further processing.

The above description is illustrative of various principles and implementations of the present disclosure. Numerous variations and modifications will become apparent to those skilled in the art once the above disclosure is fully appreciated. Accordingly, the scope of the present application should be determined only by the following claims.

What is claimed is:

1. A system comprising:
- a conveyor;
- a first developer unit to:
  - concentrate first printing liquid, and
  - deliver the first printing liquid to the conveyor as a first layer of printing liquid;
- a second developer unit to:
  - concentrate second printing liquid, and
  - deliver the second printing liquid to the conveyor as a second layer of printing liquid delivered onto the first layer of printing liquid delivered by the first developer unit;
- a wiper in contact with the conveyor, the wiper to remove the first and second layers of printing liquid from the conveyor;
- a squeegee unit situated between the first developer unit and the second developer unit along the conveyor, the squeegee unit to apply forces to the first layer of printing liquid on the conveyor to concentrate the first layer of printing liquid.

2. The system of claim 1, wherein the second layer indistinguishably mixes with first layer upon delivery of the second layer onto the first layer, resulting in a mixed layer of printing liquid.

3. The system of claim 2, wherein the wiper is to remove the mixed layer of printing liquid from the conveyor.

4. The system of claim 1, wherein the forces applied by the squeegee unit to the first layer of printing liquid on the conveyor to concentrate the first layer of printing liquid are mechanical and electrical forces.

5. The system of claim 1, further comprising a plurality of additional squeegee units after the second developer unit, the plurality of additional squeegee units to further concentrate the second layer of printing liquid.

6. The system of claim 5, further comprising an actuator to engage and disengage independently each of the squeegee unit and the plurality of additional squeegee units to and from the conveyor to adjust a concentration of the first and second layers of printing liquid removed by the wiper.

7. The system of claim 1, further comprising an actuator to engage and disengage independently each of the first and second developer units to and from the conveyor.

8. A method comprising:
- concentrating first printing liquid on a first developer roller;
- transferring the first printing liquid to a conveyor as a first layer of printing liquid;
- further concentrating the first printing liquid on the conveyor using a first squeegee unit, after the first printing liquid has been transferred to the conveyor and before the second printing liquid has been transferred to the conveyor;
- concentrating second printing liquid on a second developer roller, after the first printing liquid has been further concentrated using the first squeegee unit;
- transferring the second printing liquid to the conveyor as a second layer of printing liquid delivered onto the first layer of printing liquid, wherein the second printing liquid mixes with the first printing liquid upon transfer of the of the second printing liquid on top of the first printing liquid, resulting in mixed printing liquid; and
- removing the mixed printing liquid from the conveyor.

9. The method of claim 8, further comprising concentrating the mixed printing liquid using a second squeegee unit, after the second printing liquid has been transferred to the conveyor.

10. The method of claim 8, further comprising removing the first and second printing liquids from the conveyor, wherein the first and second printing liquids have an overall non-volatile solid concentration of at least 30% when removed from the conveyor.

11. The method of claim 8, wherein the first printing liquid transferred to the conveyor has a non-volatile solid concentration of at least 15%.

12. The method of claim 8, wherein the first printing liquid on the conveyor is further concentrated to have a non-volatile solid concentration of at least 20%.

13. The method of claim 8, wherein the second printing liquid transferred to the conveyor has a non-volatile solid concentration of at least 20%.

14. An apparatus comprising:
- a conveyor;
- a first developer unit to:
  - concentrate first printing liquid, and
  - deliver the first printing liquid to the conveyor as a first layer of printing liquid;
- a second developer unit to:
  - concentrate second printing liquid, and
  - deliver the second printing liquid to the conveyor as a second layer of printing liquid delivered onto the first printing liquid to form a thick layer of printing liquid comprising the first and second printing liquids; and a squeegee unit between the first developer unit and the second developer unit to further concentrate the first printing liquid on the conveyor.

15. The apparatus of claim 14, wherein the thick layer of printing liquid has a thickness of at least 5 micrometers.

16. The apparatus of claim 14, further comprising a second squeegee unit to further concentrate the thick layer of printing liquid, wherein the thick layer of printing liquid has a thickness of at least 5 micrometers after the further concentration.

17. The apparatus of claim 14, further comprising a wiper to scrape the thick layer of printing liquid from the conveyor.

* * * * *